United States Patent [19]

Farris et al.

[11] Patent Number: 4,665,899

[45] Date of Patent: May 19, 1987

[54] APPARATUS FOR ARTICULATING THE KNEE AND HIP JOINTS

[75] Inventors: Ray L. Farris, Holtville; Michael F. Rodi, San Diego; Ray L. Farris, Orange, all of Calif.; George Wylesol, Cheltemham, Pa.; Thomas A. Cook, Cherry Hill, N.J.

[73] Assignee: Joint Mobilizer Systems Corp., San Diego, Calif.

[21] Appl. No.: 792,174

[22] Filed: Oct. 28, 1985

Related U.S. Application Data

[63] Continuation-in-part of Ser. No. 655,334, Sep. 27, 1984, abandoned, which is a continuation of Ser. No. 397,998, Jul. 14, 1982, abandoned.

[51] Int. Cl.[4] ..... A61H 1/02

[52] U.S. Cl. ..... 128/25 R; 128/25 B

[58] Field of Search ..... 128/25 R, 25 B, 24-R, 128/44, 51-52, 56, 57; 272/96; 74/89.15

[56] References Cited

U.S. PATENT DOCUMENTS

| | | | |
|---|---|---|---|
| 2,696,206 | 12/1954 | Bierman | 128/51 |
| 2,763,261 | 9/1956 | Masmonteil et al. | 128/50 X |
| 3,659,594 | 5/1972 | Schwab | 128/75 X |
| 3,742,940 | 7/1973 | Phiffer | 128/25 R |
| 3,774,597 | 11/1973 | Root | 128/25 B |
| 3,917,261 | 11/1975 | Small et al. | 272/57 D |
| 3,976,057 | 8/1976 | Barclay | 128/25 R |
| 4,185,622 | 1/1980 | Swenson | 128/25 B |
| 4,186,920 | 2/1980 | Fiore et al. | 272/96 |
| 4,323,060 | 4/1982 | Pecheux | 128/75 X |
| 4,412,534 | 1/1983 | Hamabe et al. | 128/52 |
| 4,537,083 | 8/1985 | Saringer | 128/52 X |
| 4,549,534 | 10/1985 | Zagorski et al. | 128/25 R |

FOREIGN PATENT DOCUMENTS

| | | | |
|---|---|---|---|
| 2015054 | 10/1971 | Fed. Rep. of Germany | 128/25 |
| 2524468 | 12/1976 | Fed. Rep. of Germany | 272/144 |
| 2407710 | 7/1979 | France | 128/52 |

OTHER PUBLICATIONS

"Sutter CPM TM 2000S" Sutter Biomedical Inc. sales brochure, Jun. 1984.

*Primary Examiner*—Richard J. Apley
*Assistant Examiner*—J. Welsh
*Attorney, Agent, or Firm*—Baker, Maxham & Jester

[57] ABSTRACT

A carriage is longitudinally reciprocated along a fixed base by a motor. A first pair of arms are pivotally connected at their lower ends to opposite sides of the base. A second pair of arms are pivotally connected at their upper ends to corresponding ones of the upper ends of the first arms and at their lower ends to opposite sides of the carriage. With a person reclined on his or her back, one of the person's legs extends between the first arms and between the second arms. The foot is held to a foot support pivotally mounted on the carriage. The thigh is held in a thigh support which extends between the first arms so that reciprocating movement of the carriage articulates the knee and hip joints of the leg.

19 Claims, 9 Drawing Figures

FIG. 1
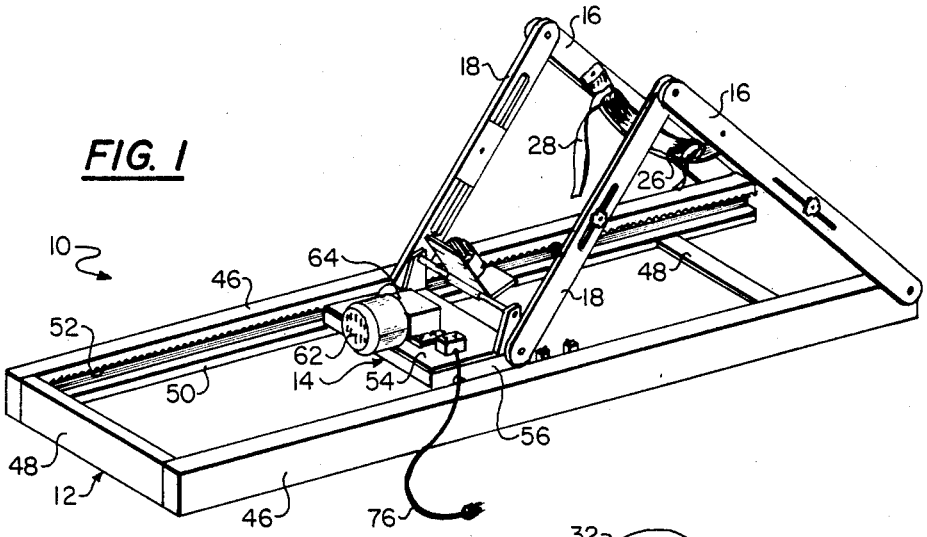
FIG. 2
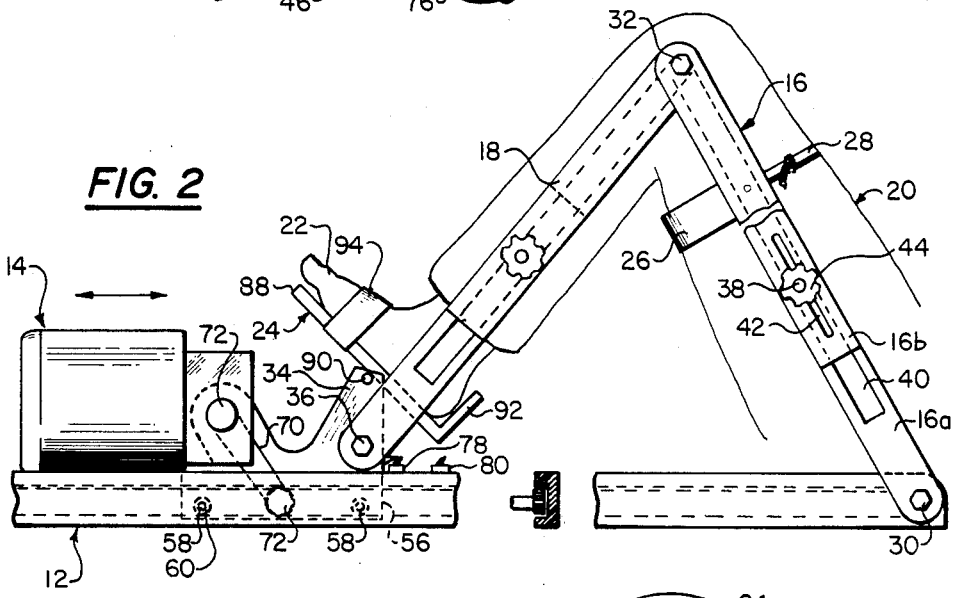
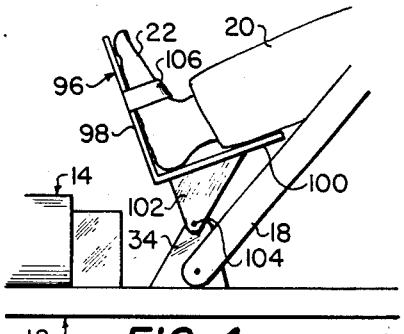
FIG. 4
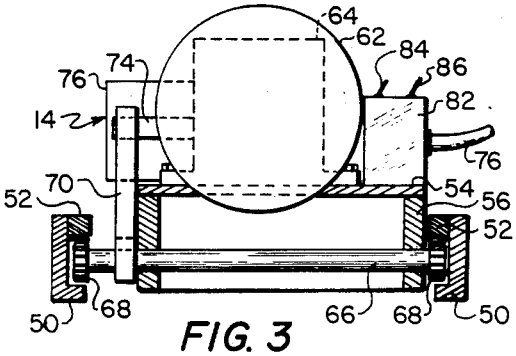
FIG. 3

APPARATUS FOR ARTICULATING THE KNEE AND HIP JOINTS

CROSS-REFERENCE TO RELATED APPLICATIONS

This application is a continuation-in-part of abandoned U.S. patent application Ser. No. 655,334 filed Sept. 27, 1984 which in turn was a continuation of abandoned U.S. patent application Ser. No. 397,998 filed July 14, 1982.

BACKGROUND OF THE INVENTION

The present invention relates to exercise devices, and more particularly, to an apparatus for articulating the knee and hip joints for therapeutic purposes.

In some cases, persons can benefit from artificially induced motion to their lower extremities, and in particular from artificially induced articulation of the knee and hip joints. For example, when a person is recovering from knee or hip surgery, such artificially induced motion may prove helpful in overcoming muscle atrophy.

In the past, a number of different devices have been developed for artificially exercising a person's limbs. For example, U.S. Pat. No. 3,976,057 of Barclay discloses an apparatus for flexing the knee joint which includes a pair of straps which are wrapped around the calf and thigh, respectively. The straps are hingedly connected at the knee joint by mechanical linkages secured to the straps. These linkages are moved by pneumatic cylinders to articulate the knee.

U.S. Pat. No. 3,774,597 of Root discloses a device for artificially simulating the act of walking by holding the knees substantially stationary while sequentially elevating the hells, depressing the unsupported arches, and flexing the toes.

U.S. Pat. No. 3,917,261 of Small et al and U.S. Pat. No. 4,185,622 of Swenson disclose dual footrests which are reciprocated by a motor.

U.S. Pat. No. 3,742,940 of Phiffer discloses an exercise device including an elongate fixed base having a sliding base on which is mounted an oscillating footrest. A seat is resiliently mounted to the fixed base and a control lever is provided for controlling the location of the footrest relative to the seat.

U.S. Pat. No. 4,323,060 of Pecheux discloses an articulated frame for supporting a patient's leg, the frame being driven back and forth by a pneumatic cylinder. The foot is supported on a longitudinally adjustable, but otherwise stationary, foot support plate connected to the frame. Hammocks extend between the parallel rods of the frame to support the leg.

U.S. Pat. No. 4,186,920 of Fiore et al. discloses a foot support connected to a base of a ball and socket joint enabling the support to be tilted in any direction by a foot supported thereby.

U.S. Pat. No. 3,659,594 of Schwab discloses a trapeze type orthopedic device for the treatment of vertebral disorders.

U.S. Pat. No. 2,763,261 of Masmonteil et al. discloses a deformable cradle including three pivotally connected sections for carrying the thigh, calf and the foot of a patient. The foot support is connected to a carriage which is driven along rails. The cradle is flexed at the junction of its thigh and calf sections by a hydraulic cylinder through a linkage.

U.S. Pat. No. 2,696,206 of Bierman discloses an apparatus having a pair of foot/calf supports which are oppositely driven through a chain to simultaneously exercise both of a patient's legs in a to-and-fro manner.

U.S. Pat. No. 4,412,534 of Hamabe et al. discloses a massage table in which a pair of wheels are reciprocated underneath a cover sheet via a rack and pinion gear drive.

German Pat. No. 2015054 of Bimler discloses another leg supporting articulated frame.

German Pat. No. 2524468 of Lang discloses another motor driven articulated leg supporting frame with a parallelogram guide and telescoping capability.

SUMMARY OF THE INVENTION

Accordingly, it is the primary object of the present invention to provide an apparatus for articulating the knee and hip joints of a person.

Another object of the present invention is to provide such an apparatus which may be readily adjusted to accommodate persons of different heights.

Another object of the present invention is to provide such an apparatus which the person's knee and hip joints are articulated while the person is in a reclined position.

Yet another object of the present invention is to provide such an apparatus in which the amount of extension and retraction of the legs may be adjusted.

Still another object of the present invention is to provide such an apparatus which has a simple, reliable construction.

According to the present invention a carriage is longitudinally reciprocated along a fixed base by a motor. A first pair of arms are pivotally connected at their lower ends to opposite sides of the base. A second pair of arms are pivotally connected at their upper ends to corresponding ones of the upper ends of the first arms and at their lower ends to opposite sides of the carriage. With a person reclined on his or her back, one of the person's legs extends between the first arms and between the second arms. The foot is held to to a foot support pivotally mounted on the carriage. The thigh is held in a thigh support which extends between the first arms so that reciprocating movement of the carriage articulates the knee and hip joints of the leg.

BRIEF DESCRIPTION OF THE DRAWINGS

FIG. 1 is a perspective view of a first embodiment of our apparatus for articulating a person's knee and hip joints.

FIG. 2 is an enlarged, fragmentary side elevation view of the first embodiment illustrating one of the person's legs strapped thereto.

FIG. 3 is a still further enlarged end view of the carriage of the first embodiment with portions broken away.

FIG. 4 is an enlarged view of an alternate foot support which may be attached to the first embodiment to raise the leg and impart greater hip articulation.

DESCRIPTION OF THE PREFERRED EMBODIMENT

Figure 5:
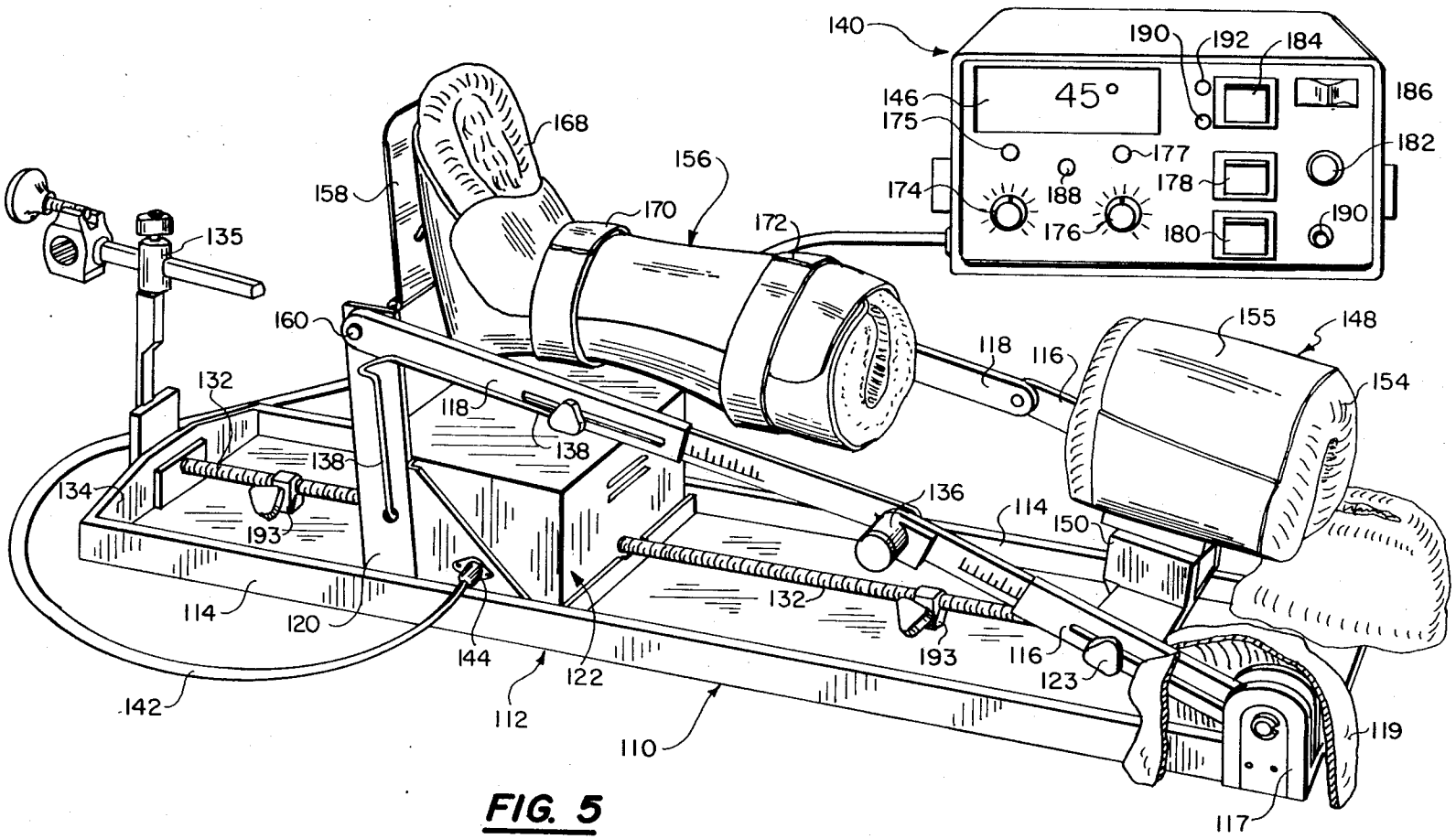
FIG. 5 is a perspective view of a second embodiment of our apparatus for articulating a person's knee and hip joints.

Referring to FIG. 1, a first embodiment 10 of our invention includes a fixed, elongate base 12, a carriage 14 longitudinally reciprocable along the base, and first and second pairs of arms 16 and 18. The arms are pivotally connected to each other, to opposite sides of the base 12 and to opposite sides of the carriage 14. The arms are spaced a sufficient distance apart so that when a person is lying on his or her back, one of the person's legs 20 can extend between the arms as illustrated in FIG. 2 with the foot 22 carried by a foot support 24 mounted on the carriage 14.

Back and forth motion of the carriage 14 as indicated by the arrow in FIG. 2 articulates the knee and hip joints of the particular leg. Arms 16 and 18 retract to their positions illustrated in FIG. 2 when the carriage has moved to its farthest point to the right. When the carriage moves to its farthest point to the left, the arms 16 and 18 extend so that they lie near the base 12 along their entire length. Thus, reciprocal motion of the carriage will articulate the person's knee and hip joints.

A curved thigh cup 26 has its opposite ends connected to corresponding ones of the first arms 16 as illustrated in FIGS. 1 and 2. The thigh cup is connected intermediate the lengths of the first arms 16 and supports the thigh to insure proper articulation of the hip joint. A strap 28 connected to the thigh cup is buckled around the upper part of the thigh to hold it to the thigh cup.

The first arms 16 are pivotally connected at their lower ends to opposite sides of the base 12 by bolts 30 (FIG. 2). The upper ends of the second arms 18 are pivotally connected to corresponding ones of the upper ends of the first arms 16 by bolts 32. The lower ends of the second arms 18 are pivotally connected to opposite side pieces 34 of the carriage 14 by bolts 36.

The first and second arms 16 and 18 include means for permitting them to be selectively extended and retracted so that the apparatus can be utilized by persons of varying height. As illustrated in FIG. 2, each of the arms, such as 16 includes a first part 16*a* which is slidable longitudinally with respect to a second part 16*b*. The pieces 16*a* and 16*b* are held together by a bolt 38 which extends through aligned longitudinal slots 40 and 42 in the arm pieces and is secured by a quick release nut 44.

The fixed base 12 comprises a pair of longitudinally extending side pieces 46 (FIG. 1) connected by a pair of laterally extending end pieces 48. The lower ends of the first arms 16 are pivotally connected to corresponding ends of the side pieces 46. The carriage 14 reciprocates back and forth between the side pieces 46. As best seen in FIG. 3, the inside surface of each side piece has a lower rail 50 and an upper rack gear 52.

The carriage 14 includes a horizontal platform 54 and a pair of axle plates 56 (FIGS. 1 and 2) which extend downwardly from the sides of the platform 54 and adjacent corresponding ones of the side pieces 46. A pair of axles 58 (FIG. 2) extend laterally through the axle plates 56. Cams or wheels 60 mounted on the ends of the axles roll along the rails 50.

Motor means are provided for reciprocating the carriage 14 back and forth along the base 12. The shaft of an electric motor 62 (FIGS. 1 and 3) is coupled to a right angle gear reduction assembly 64 secured to the platform 54 of the carriage. A drive axle 66 (FIG. 3) extends laterally through the axle plates 56 and has a pair of pinion gears 68 mounted on opposite ends thereof which engage corresponding ones of the rack gears 52. A belt 70 is entrained around pulleys 72 (FIG. 2) mounted on the drive axle 66 and the output shaft 74 (FIG. 3) of the reduction gear assembly 64. The output shaft 74 and a portion of the belt 70 are enclosed within a cover 76. The cover 76 and the cover of the reduction gear assembly 64 shield a portion of the driving connection of the carriage 14 to prevent a person's clothing from becoming entangled therewith.

The motor means which reciprocates the carriage further includes circuit means connected to the motor 62 and connectable to a source of electric power through a cord 76. The circuit means is adapted to reverse the motor after predetermined amounts of extension and retraction of the arms. A pair of limit switches 78 and 80 (FIG. 2) are mounted at longitudinally spaced locations along one of the side pieces 46 of the base. These switches are actuated by physical contact with the arm 18 which pivots immediately above the switches. The switch 78 opens when the arms reach their fully retracted positions illustrated in FIG. 2. The opening of the switch 78 is used to reverse the direction of the motor 62 to cause the carriage to move to the left in FIG. 2. Thereafter, when the arms reach their fully extended positions, they close the switch 80 which causes the motor 62 to again be reversed so that the carriage begins to travel back to the right. The longitudinal positions of the limit switches 78 and 80 may be adjusted to vary the amount of extension and retraction.

The motor 14 is preferably an AC induction motor. A box 82 (FIG. 3) mounted on the carriage encloses solid state circuitry connected to the power cord 76 and to the limit switches 78 and 80 for reversing the motor 62. The circuit means further includes a pair of toggle switches 84 and 86 (FIG. 3) mounted on top of the box 82. The switch 84 may be a three-position switch providing for OFF, MANUAL and AUTOMATIC OPERATION modes. In the AUTOMATIC mode, the carriage repeatedly cycles back and forth to cause the knee and hip joints to be articulated. When the switch 84 is in its manual position, the switch 86 may be moved between UP and DOWN positions. When the switch 86 is is in its UP position, the carriage will move to the right to fully retract the arms and then will stop. When the switch 86 is moved to its DOWN position, the carriage will move to the left to fully extend the arms and then stop.

The foot support 24 (FIG. 2) includes a generally rectangular plate 88 having a laterally extending axle 90 secured to the underside thereof substantially intermediate its width. The ends of the axle 90 are journaled in holes in the upper ends of the side pieces 34. A heel support 92 extends upwardly from one end edge of the plate 88, perpendicular thereto. A strap 94 is used to hold the foot 22 against the foot support. A torsion spring (not visible in the figures) surrounds the axle 90 and engages the plate 88 to urge the foot support to a predetermined neutral position.

FIG. 4 illustrates an alternate foot support 96 which may be used in substitution for the foot support 24. The foot support 96 raises the foot higher so that reciprocation of the carriage 14 results in greater articulation of the hip joint. It includes a plate 98 having a heel support 100 which extends upwardly from one end edge of the plate. A pair of triangular side pieces 102 extend from opposite sides of the plate. An axle 104 extends through holes in the apexes of the pieces 102 and through the holes in the pieces 34 to pivotally mount the foot support to the carriage 14. A strap 106 secures the foot 22 to the plate 98.

Figure 6:
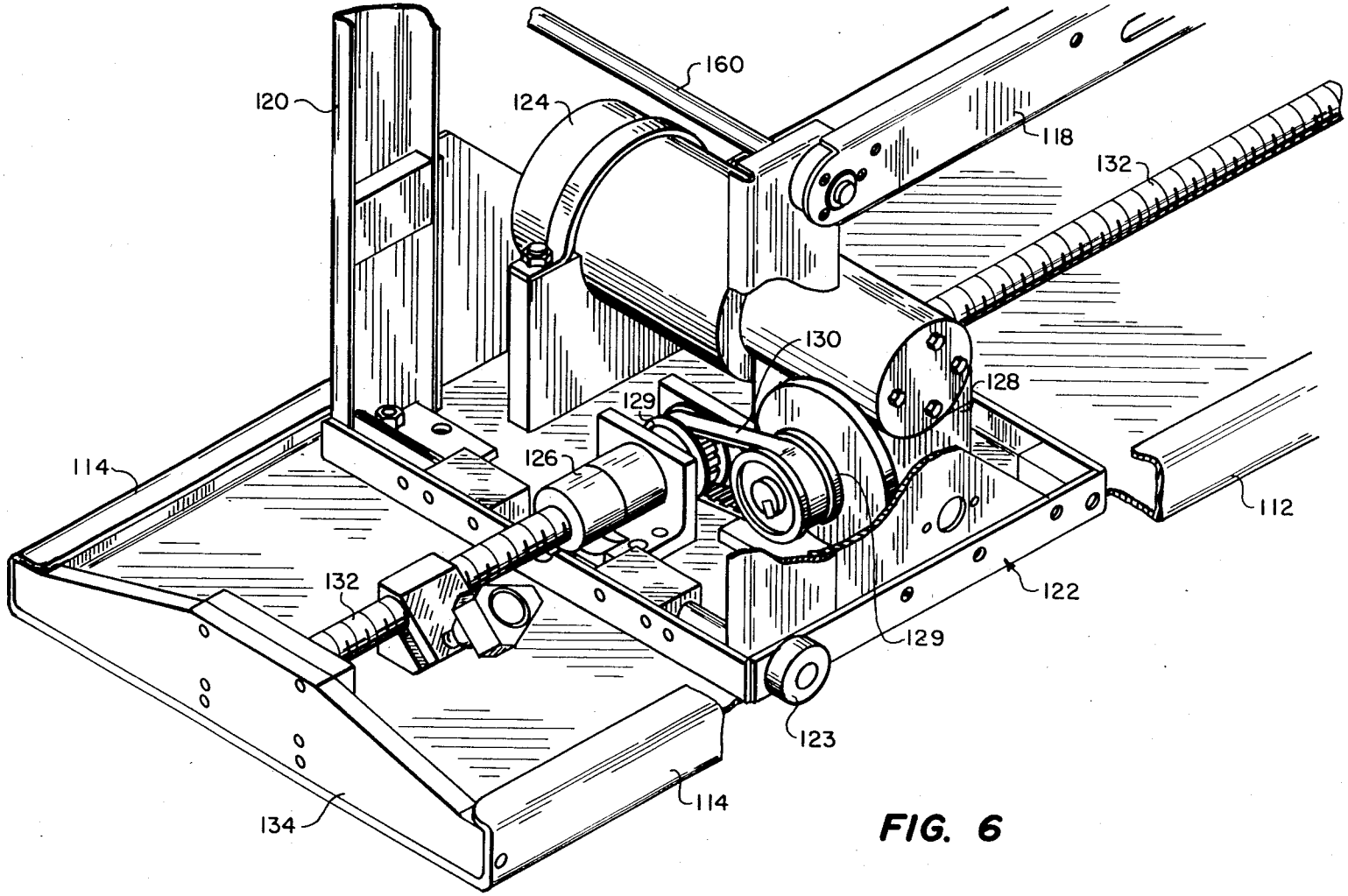
FIG. 6 is an enlarged fragmentary view of the horizontal base and carriage of the second embodiment.

Referring to FIG. 5, a second embodiment 110 of our invention includes a horizontal, rectangular base 112 having side rails 114. A pair of telescoping femoral arms 116 are pivotally connected at their lower ends to respective trunnions 117 mounted to the rear ends of the side rails 114. The upper ends of the femoral arms are pivotally connected to the upper ends of a pair of telescoping tibial arms 118. The trunnion 117 are shielded by padding 119. The lower ends of the tibial arms 118 are pivotally connected to side pieces 120 which extend vertically from opposite sides of a carriage 122. The carriage has four wheels 123 (FIG. 6) which ride along the insides of the side rails 114. A motor 124 supported by the carriage turns a track nut 126 via gear reduction 128, pulleys 129 and timing belt 130. The track nut is screwed over a stationary threaded shaft 132 (FIG. 5) whose opposite ends are secured to the opposite end walls 134 of the base 112. A adjustable clamp mechanism 135 attached to one of the end walls 134 is used to anchor the apparatus to the hospital bed frame. Energization of the motor 124 (FIG. 6) to rotate the track nut 126 in either direction causes the carriage 122 to longitudinally reciprocate along the side rails 114 of the base, causing the femoral and tibial arms 116 and 118 to articulate up and down.

A potentiometer assembly 136 (FIG. 5) is drivingly connected to the mating ends of one set of the femoral and tibial arms 116 and 118 for generating an electrical signal upon relative angular rotation of the arm. This signal is carried along wires 138 to the carriage and from the carriage to a control unit 140 via a cable 142. The cable is operatively connected to the electrical mechanisms inside the carriage via a female jack 144 on the side of the carriage. The signal from the potentiometer assembly 136 is processed by the control unit 140 which indicates an accurate measurement of the degrees of flexion and extension on an LED display 146 throughout the entire range of motion of a patient's leg carried by the articulating femoral and tibial arms.

Figure 7:
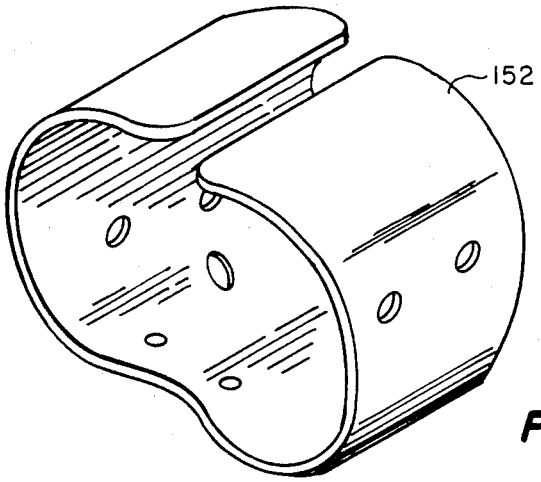
FIG. 7 is an enlarged perspective view of the thigh supporting sleeve of the second embodiment.

A thigh support or thigh cradling means 148 (FIG. 5) is connected between the femoral arms 116 via floating coupling 150. That coupling allows natural knee movement by permitting undisturbed gliding and rotation of the patient's knee joint. Its construction is described hereafter in greater detail. The thigh support 148 includes a molded plastic sleeve 152 (FIG. 7) with a fiber fill liner 154 (FIG. 5). The sleeve cradles the patient's thigh. A single wide strap 155 is positioned for encircling the thigh support for holding the patient's leg securely in place. The ends of the strap have mating hook weave fabric sections for detachably securing them together. One suitable mating hook weave material is sold under the trademark VELCRO.

Figure 8:
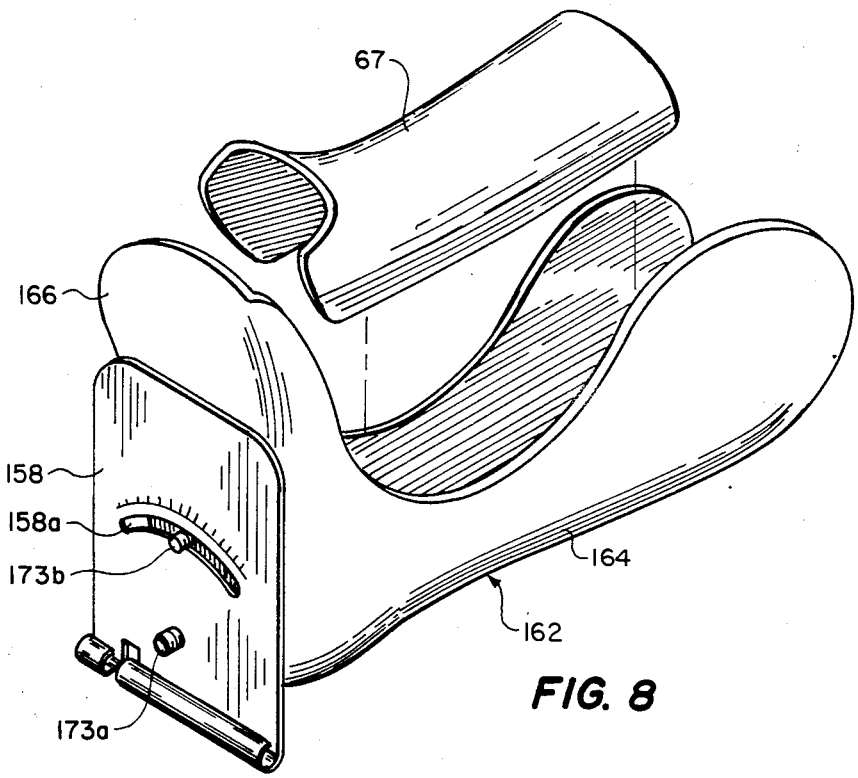
FIG. 8 is an enlarged perspective view of the cup-shaped calf support of the second embodiment.

A combined calf/foot support 156 (FIG. 5) is connected to a footplate 158 and extends longitudinally between the pair of tibial arms 118. The footplate is pivotally connected to an axle 160. This axle is journaled at its opposite ends in bearings (not visible) mounted in the corresponding vertical side pieces 120. The lower ends of the tibial arms 118 rotate about the axle 160. The calf/foot support 156 includes a molded plastic element 162 (FIG. 8) having cup-shaped calf supporting and foot supporting portions 164 and 166, respectively. It further includes a detachable shin portion 167. The plastic element 162 has a fiber fill liner 168 (FIG. 5). A pair of straps 170 and 172, each having hook weave mating fabric, are used to detachably secure the patient's lower leg in the calf/foot support 156. The lower part of the foot supporting portion 166 has a threaded shaft **173*a* which extends through the foot support plate 158. Another threaded shaft 173*b* extends from the upper part of the foot supporting portion 166 and is movable in an arcuate slot 158*a* in the plate 150 as the plastic element 162 is rotated about shaft 173*a*. Threaded knobs (not illustrated) are screwed over the shafts 173*a* and 173*b* to secure the calf/foot support 156** in the desired angular position relative to the longitudinal axis of the frame of the apparatus.

The thigh support 148 and the calf/foot support 156 provide for maximum support and control of the patient's leg during flexion and extension. They reduce stress on the surgical site and enhance patient comfort. The liners 154 and 168 are made of a soft material for comfort and are preferably removable for cleaning and replacement. One suitable liner material that promotes comfort and hygiene is sold under the trademark KODEL.

The control unit 140 (FIG. 5) has knobs 174 and 176 for independently selecting the degree of extension and flexion of the leg, respectively. The extension may be set directly by referring to the calibrations around the knob 174 or by positioning the femoral and tibial arms 116 and 118 and then turning the knob until a position indicator light 175 is illuminated. The flexion may be similarly set directly via knob 176 and its associated calibration marks or by positioning the arms 116 and 118 and turning the knob 176 until a light 177 is illuminated. Pushbuttons 178 and 180 allow positioning of the leg in the extension or flexion direction. Speed control knob 182 allows the operator to change the speed of the apparatus between a range of, for example, a maximum speed that will allow a full mechanical travel cycle in just under sixty seconds down to a barely perceptible movement. Pushbutton 184 is depressed to initiate automatic operation after the degree of extension and flexion and the speed have been selected.

An illuminated rocker switch 186 (FIG. 5) turns power to the control unit on and off. An indicator lamp 188 is illuminated any time the flexion and extension knobs 174 and 176 have been set to positions which cross. The apparatus will not operate in its automatic mode until this condition is corrected. A remote pushbutton (not illustrated) may be plugged into the control unit via female jack 190 to allow the patient to initiate and terminate the automatic mode of operation from his or her reclined position away from the control unit. The digital display 146 can produce two different displays depending upon the position of toggle switch 190. Either the instantaneous position of the arms 116 and 118, and thus the patient's leg, in degrees of flexion or the number of auto-cycle repetitions completed, can be displayed. The repetition counter can count up to 999,999 repetitions, for example, and is re-set when the power is switched off or the reset button 192 is depressed. Movable safety stops 193 (FIG. 5) may be secured to the threaded shaft 132 to establish safety limits for extension and flexion.

Figure 9:
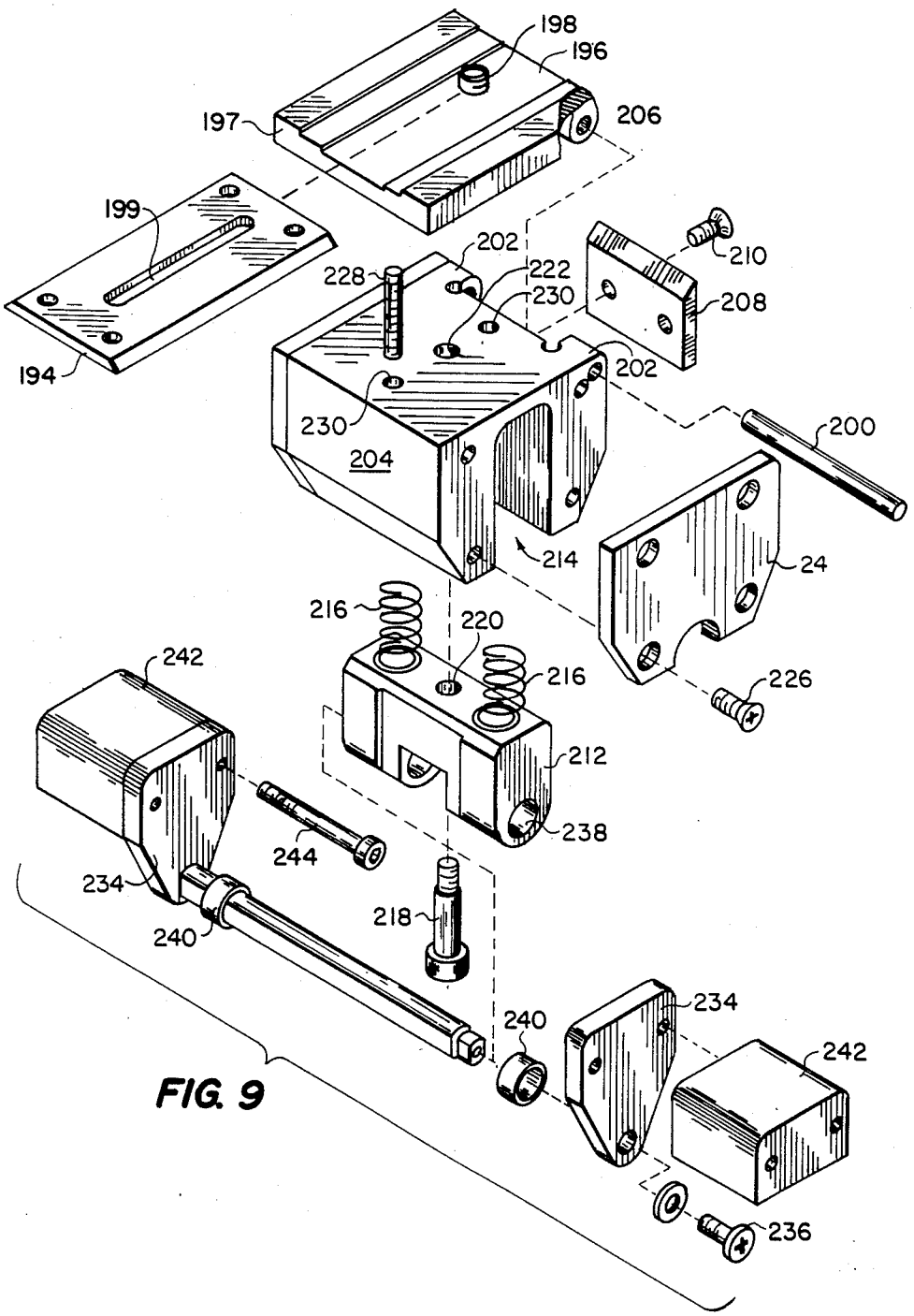
FIG. 9 is an enlarged exploded perspective view of the floating coupling which mounts the thigh support to the femoral arms in the second embodiment.

The construction of the floating coupling 150 is illustrated in detail in FIG. 9. Plate 194 which is bolted to the thigh support sleeve 152 is configured for a sliding dove-tail fit into angled groove 196 formed in base member 197. A shaft 198 threaded into the base member fits in a longitudinal slot 199 of the plate 194 to limit its travel. A pin 200 slides through trunion portions 202 of mounting block 204 and through sleeve portion 206 of base member 197. End piece 208 is secured to the rear face of the mounting block 204 by screws 210. A yoke 212 is received in a downwardly opening transverse slot 214 formed in the medial portion of the mounting block 204. A pair of springs 216 are positioned between the yoke 212 and the block 204 and permit vertical travel of the yoke within the slot upon the application of sufficient force. A bolt 218 extends through a hole 220 in the middle of the yoke 212 and is threaded into a hole 222 in the mounting block 204. The bolt 218 has a smooth intermediate segment over which the yoke 212 slides. Plates 224 are secured to either side of the mounting block 204 by screws 226 and provide lateral retaining means for the pin 200. Stops 228 are threaded into holes 230 in the upper surface of the block for engaging the base member 197 when it swings down against the block 204.

Referring still to FIG. 9, the opposite ends of an axle 232 are secured to corresponding brackets 234 by screws 236. The axle extends through a transverse bore 238 in the lower portion of the yoke 212 which is centered on the axle by bushings 240. The brackets 234 are secured to corresponding spacer blocks 242 and to respective ones of the femoral arms by bolts such as 244.

From the description of the floating coupling 150 above, it will be readily understood that the thigh support 148 (FIG. 5) permits the patient's thigh to move in a plurality of different degrees of freedom relative to the femoral arms 116. In particular, the thigh may move longitudinally and vertically and transversely relative to the arms 116. In addition, the thigh may rotate about an axis extending generally longitudinally relative to the arms 116 and about an axis extending generally transversely relative to the arms 116. The floating coupling 150 thus allows natural movement of the patient's leg by permitting undisturbed gliding and rotation of the patient's knee joint.

Having described two embodiments of our apparatus for articulating the knee and hip joints, it should be apparent to those skilled in the art that our invention may be modified in both arrangement and detail. Therefore, the protection afforded our invention should be limited only in accordance with the scope of the following claims.

We claim:

1. An apparatus for articulating the knee and hip joints of a person's leg comprising:

a fixed elongate base having two side pieces that are spaced apart to straddle the leg and permit the placement thereof along side the leg adjacent the hip joint without raising the person from a reclined position:

a carriage longitudinally reciprocable along the base;

a motor mounted on the carriage and having a drive shaft;

a drive member extending longitudinally along the base;

means for coupling the shaft of the motor to the drive member so that rotation of the shaft in opposite directions will cause the carriage to reciprocate along the base;

a first pair of arms pivotally connected at their lower ends to opposite sides of the base a sufficient distance apart to enable a thigh of the leg to extend between the first arms, each arm of the first pair having an adjustable length to accommodate different thigh lengths;

a second pair of arms pivotally connected at their upper ends to corresponding ones of the upper ends of the first pair of arms, the lower ends of the arms of the second pair being pivotally connected to opposite sides of the carriage a sufficient distance apart to enable a calf of the leg to extend between the second arms, each arm of the second pair having an adjustable length to accommodate different calve lengths;

a support for the foot of the leg;

means for pivotally mounting the foot support on the carriage;

means for holding the thigh to the first arms, including means for cradling the thigh and floating coupling means for connecting the thigh cradling means between the pair of first arms to permit longitudinal and rotational motion of the cradling means relative to the first arms during reciprocation of the carriage;

means for holding the foot on the support; and means connected to the motor and connectable to a source of electric power for reversing the motor after predetermined amounts of extension and retraction of the arms to permit extension and flexion of the leg without substantially raising the person's foot.

2. An apparatus according to claim 1 wherein the drive member is an externally threaded shaft.

3. An apparatus according to claim 2 and further comprising a pair of safety stops surrounding the threaded shaft at spaced apart locations along the same.

4. An apparatus according to claim 1 wherein the drive member is a rack gear.

5. An apparatus according to claim 1 wherein the foot support includes an upwardly opening cup-shaped member for receiving and supporting the foot and calf.

6. An apparatus according to claim 1 and further comprising cover means for shielding the coupling means to prevent entanglement with an article of clothing.

7. An apparatus according to claim 1 and further comprising means for generating an electrical signal representative of the relative angular positions of the first and second pairs of arms.

8. An apparatus for articulating the knee and hip joints of a person's leg comprising:

an elongate horizontal base;

a carriage longitudinally reciprocable along the base;

motor means for reciprocating the carriage;

a first pair of arms pivotally connected at their lower ends to a pair of opposite sides of the base a sufficient distance apart to enable a thigh of the leg to extend between the first arms;

a second pair of arms pivotally connected at their upper ends to corresponding ones of the upper ends of the first pair of arms, the lower ends of the second pair of arms being pivotally connected to opposite sides of the carriage a sufficient distance apart to enable a calf of the leg to extend between the second arms;

a support mounted on the carriage for carrying a foot of the leg;

means for holding the foot to the support;

means for cradling the thigh;

means for holding the thigh to the cradling means; and floating coupling means for connecting the cradling means between the first arms and for permitting relative rotational movement between the cradling means and the first arms.

9. An apparatus according to claim 8 wherein the floating coupling means further permits longitudinal movement of the cradling means relative to the first arms.

10. An apparatus according to claim 8 wherein the floating coupling means further permits vertical movement of the cradling means relative to the first arms.

11. An apparatus according to claim 8 wherein the rotational movement is about a generally longitudinally extending axis.

12. An apparatus according to claim 8 wherein the rotational movement is about a generally transversely extending axis.

13. An apparatus according to claim 8 wherein the floating coupling means permits rotational movement about a first longitudinally extending axis and a second transversely extending axis.

14. An apparatus according to claim 8 wherein the floating coupling permits longitudinal and rotational motion of the cradling means relative to the first arms.

15. An apparatus according to claim 14 wherein the floating coupling means permits vertical motion of the cradling means relative to the first arms.

16. An apparatus according to claim 14 wherein the floating coupling means permits rotational movement about a first longitudinally extending axis and a second transversely extending axis.

17. An apparatus according to claim 8 wherein the floating coupling means includes a mounting block having a downwardly opening slot, a yoke and means for yieldingly coupling the yoke to the block in the slot.

18. An apparatus according to claim 17 wherein the floating coupling means further includes means for providing a sliding connection between the mounting block and the cradling means and means for providing a rotating connection between the yoke and the first pair of arms.

19. An apparatus for articulating the knee and hip joints of a person's leg comprising:

an elongate horizontal base;

a carriage longitudinally reciprocable along the base;

motor means for reciprocating the carriage;

a first pair of arms pivotally connected at their lower ends to a pair of opposite sides of the base a sufficient distance apart to enable a thigh of the leg to extend between the first arms;

a second pair of arms pivotally connected at their upper ends to corresponding ones of the upper ends of the first pair of arms, the lower ends of the second pair of arms being pivotally connected to opposite sides of the carriage a sufficient distance apart to enable a calf of the leg to extend between the second arms;

a support mounted on the carriage for carrying a foot of the leg;

means for holding the foot to the support;

means for cradling the thigh;

means for holding the thigh to the cradling means; and floating coupling means for connecting the cradling means between the first arms and for permitting relative vertical movement between the cradling means and the first arms.

* * * * *